US011528563B2

(12) United States Patent
Ji et al.

(10) Patent No.: US 11,528,563 B2
(45) Date of Patent: Dec. 13, 2022

(54) HYBRID RECEIVER HAVING FIXING BRACKET FOR DRIVERS

(71) Applicant: EM-TECH Co., Ltd., Gyeongsangnam-do (KR)

(72) Inventors: Yong Ju Ji, Gyeongsangnam-do (KR); Jun Hee Han, Gyeongsangnam-do (KR)

(73) Assignee: EM-TECH Co., Ltd., Gyeongsangnam-do (KR)

( * ) Notice: Subject to any disclaimer, the term of this patent is extended or adjusted under 35 U.S.C. 154(b) by 0 days.

(21) Appl. No.: 17/480,227

(22) Filed: Sep. 21, 2021

(65) Prior Publication Data

US 2022/0095056 A1 Mar. 24, 2022

(30) Foreign Application Priority Data

Sep. 22, 2020 (KR) ..... 10-2020-0121898
Jun. 11, 2021 (KR) ..... 10-2021-0076253

(51) Int. Cl.
*H04R 11/02* (2006.01)

(52) U.S. Cl.
CPC ..... *H04R 11/02* (2013.01)

(58) Field of Classification Search
CPC ..... H04R 9/025; H04R 9/06; H04R 31/006; H04R 1/24
See application file for complete search history.

(56) References Cited

U.S. PATENT DOCUMENTS

2014/0169583 A1* 6/2014 Huang ..... H04R 1/24 381/74
2020/0245058 A1* 7/2020 Lee ..... H04R 9/025

FOREIGN PATENT DOCUMENTS

KR 101634236 B1 6/2016
KR 101907513 B1 10/2018

* cited by examiner

*Primary Examiner* — Sunita Joshi
(74) *Attorney, Agent, or Firm* — Murphy, Bilak & Homiller, PLLC

(57) ABSTRACT

A hybrid receiver includes a dynamic driver including a frame, magnetic circuit, voice coil vibrated by the magnetic circuit and a mutual electromagnetic force, and a diaphragm to which the voice coil is attached to vibrate, a balanced armature driver including a housing, a magnetic circuit, a coil, an armature magnetized by a magnetic field of the coil to interact with the magnetic circuit, a rod vertically connected to the armature, and a diaphragm vibrated by the rod, and a bracket coupled to an upper portion of the diaphragm of the dynamic driver and having a sound emission port configured to emit sound of the dynamic driver. The bracket has a balanced armature driver accommodation space on an upper surface thereof. The balanced armature driver is disposed such that the diaphragm is parallel to the upper surface of the bracket. The housing has a sound emission hole above the diaphragm.

10 Claims, 16 Drawing Sheets

HYBRID RECEIVER HAVING FIXING BRACKET FOR DRIVERS

TECHNICAL FIELD

The present disclosure relates to a hybrid receiver having a fixing bracket for drivers, and more particularly, to a hybrid receiver having a fixing bracket allowing an armature driver and a dynamic driver to be easily detachably attached thereto.

BACKGROUND

Today, with the development of portable multimedia devices, receivers reproducing sound of multimedia devices are required to have high power, and accordingly, earphones using hybrid receivers, 2-way receivers, multiple drivers, and TWS earphones are strong in the market.

Within an audible frequency, a sound range may be divided into low, mid, and high range sound pressures, and there is a limit to covering all sound pressures with a general sol driver. Therefore, multiple drivers may be employed to achieve a target sound pressure in each sound range.

In particular, in the case of a hybrid receiver that combines different types of drivers, a compact and stable mechanical structure for fixing each driver is required.

FIG. 1 is a view illustrating a hybrid earphone according to a related art. The hybrid earphone according to the related art may include a housing 10, a first speaker 20, a second speaker 30, a circuit board 40, and a sound filter 50.

The housing 10 may have an accommodation space therein and a sound output port for outputting sound externally and may include an upper body 11, a lower body 12, a holder 13 and a wave guide 14.

The upper body 11 is a component accommodating an upper portion of the second speaker 30, and according to implementation, an upper cover 11*a* for opening and closing a portion of the upper body 11 may be further provided, and in this case, the upper cover 11*a* may be formed of a transparent material.

The lower body 12 has a step 12*a* formed along an inner circumferential surface thereof to support an outer lower surface of the second speaker 30, and a sound filter 50 is seated on an inner side of the step 12*a*.

The holder 13 is a component for fixing the second speaker 30 by the combination of the upper body 11 and the lower body 12, and in an embodiment of the present disclosure, a predetermined recess is provided to allow the second speaker 30 to be seated thereon, so that an upper surface of the second speaker 30 is fitted into the recess, and an air inlet (not shown) is provided on one side.

The hybrid earphone according to the related art employs a balanced armature driver speaker as the first speaker 20. In this case, the first speaker 20 is disposed within the wave guide 14, and accordingly, a length of the longest side of the first speaker 20 is limited within a length of the wave guide 14. Thus, an area obtained by subtracting a sectional area of the first speaker 20 from the wave guide 14 may be utilized as an area of a duct for transmitting sound of the second speaker 30. This leads to shortcomings in that a size of the first speaker 20 is limited, as well as a reduction in the sectional area of the duct of the second speaker 30.

Meanwhile, recently, devices for listening to music such as earphones, headsets, and TWS earsets are equipped with an active noise canceling (ANC) function in many cases. To apply the ANC function, ambient noise is actively blocked by canceling out noise using front and rear MICs (feed-forward/feed-back). As a result, in order to install a feedback microphone in a narrow front space of the housing, there is a need for more efficient arrangement of a space inside the housing.

SUMMARY

An aspect of the present disclosure provides a hybrid receiver having a fixing structure for drivers, in which an armature receiver and a dynamic receiver may be efficiently disposed in a housing.

According to an aspect of the present disclosure for achieving the above objects, there is provided a hybrid receiver having a fixing bracket for drivers and including a combination of different types of drivers, including: a dynamic driver including a frame, a magnetic circuit, a voice coil vibrated by the magnetic circuit and a mutual electromagnetic force, and a diaphragm to which the voice coil is attached to vibrate; a balanced armature driver including a housing, a magnetic circuit, a coil, an armature magnetized by a magnetic field of the coil to interact with the magnetic circuit, a rod vertically connected to the armature, and a diaphragm vibrated by the rod; and a bracket coupled to an upper portion of the diaphragm of the dynamic driver and having a sound emission port configured to emit sound of the dynamic driver, wherein the bracket has a balanced armature driver accommodation space on an upper surface thereof, the balanced armature driver is disposed such that the diaphragm is parallel to the upper surface of the bracket, and the housing has a sound emission hole above the diaphragm.

Also, as another example of the present embodiment, the hybrid receiver may further include: a shielding member installed between the balanced armature driver and the dynamic driver and configured to shield magnetism.

Also, as another example of the present embodiment, the shielding member may be installed on the upper surface of the bracket.

Also, as another example of the present embodiment, the shielding member may surround the balanced armature driver.

Also, as another example of the present embodiment, the bracket may have an air pressure balancing hole communicating with a rear space of the dynamic driver on an outer side of the dynamic driver.

Also, as another example of the present embodiment, the hybrid receiver may further include: a mesh attached to the air pressure balancing hole.

Also, as another example of the present embodiment, the dynamic driver and the balanced armature driver may each include a terminal for transmitting an electrical signal to the voice coil and a coil, and the terminal of the dynamic driver and the terminal of the balanced armature driver may be aligned to be positioned in the same direction.

Also, as another example of the present embodiment, the hybrid receiver may further include: a flexible circuit board electrically connected to the terminal of the dynamic driver and the terminal of the balanced armature driver and fixed to the bracket.

Also, as another example of the present embodiment, the terminal of the balanced armature driver transmitting an electrical signal to the coil may be installed on a side surface close to a periphery of the bracket, the bracket may surround an outer surface of the housing of the balanced armature driver, and the terminal of the balanced armature driver and the sound emission hole of the housing may be exposed to the outside of the bracket.

Also, as another example of the present embodiment, the hybrid receiver may further include: a protective cap coupled to the bracket and configured to surround the balanced armature driver.

The hybrid receiver provided in the present disclosure may increase an area of a duct used for sound transmission in a sound tube for transmitting sound to an ear canal by installing a balanced armature driver on a bracket covering an upper portion of a dynamic driver.

In addition, since the hybrid receiver provided in the present disclosure is coupled to an earphone housing in a state in which a dynamic driver and a balanced armature driver are fixed in a bracket, a deviation of relative positions of the dynamic driver and the balanced armature driver during an assembly process may be prevented, and accordingly, an acoustic deviation may also be reduced.

DETAILED DESCRIPTION

Hereinafter, the present disclosure will be described in more detail with reference to the accompanying drawings.

Figure 1:
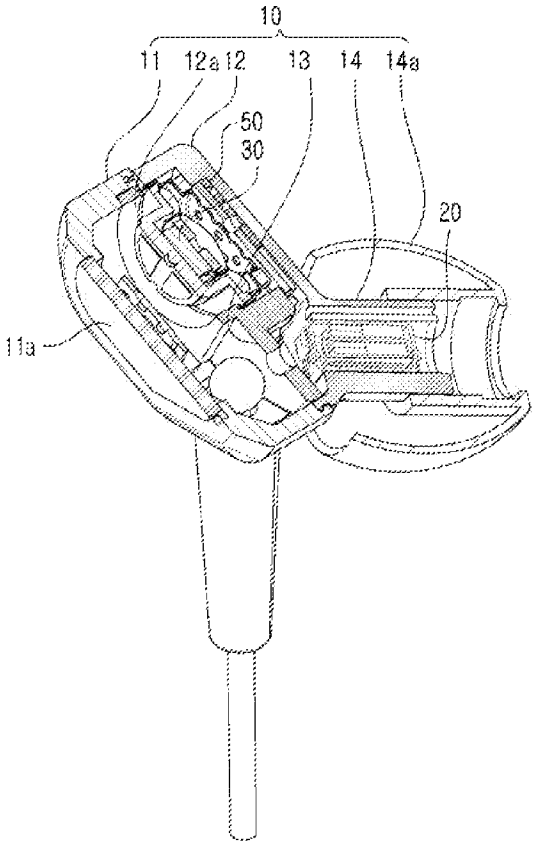
FIG. 1 is a view illustrating a hybrid earphone according to the related art.
Figure 2:
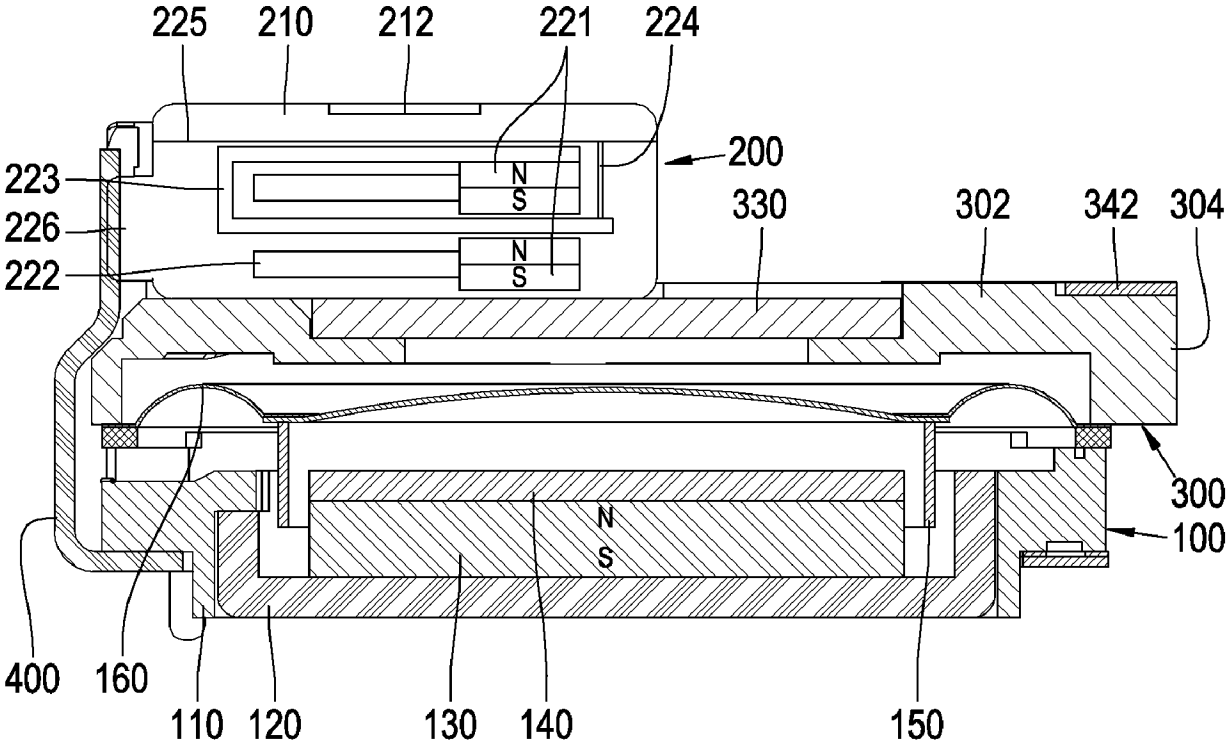
FIG. 2 is a cross-sectional view of a hybrid receiver having a fixing bracket for drivers according to a first embodiment of the present disclosure.
Figure 3:
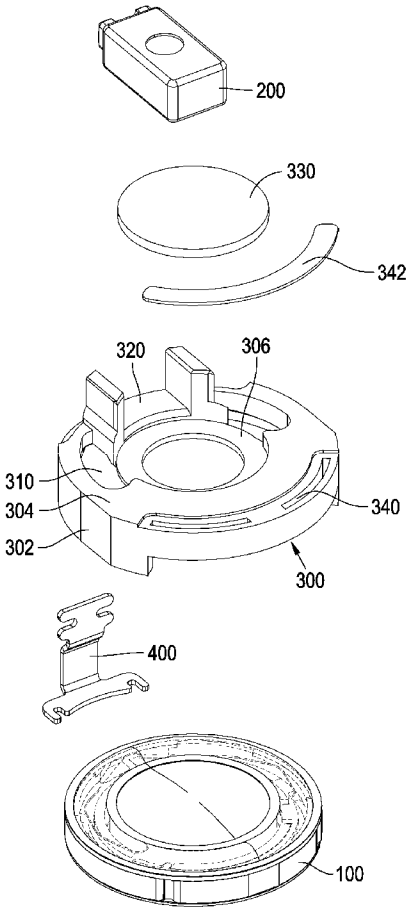
FIG. 3 is an exploded view of a hybrid receiver having a fixing bracket for drivers according to a first embodiment of the present disclosure.

FIG. 2 is a cross-sectional view of a hybrid receiver having a fixing bracket for drivers according to a first embodiment of the present disclosure, and FIG. 3 is an exploded view of a hybrid receiver having a fixing bracket for drivers according to the first embodiment of the present disclosure.

A hybrid receiver having a fixing bracket for drivers according to the first embodiment of the present disclosure includes a dynamic driver 100, a balanced armature driver 200, and a bracket 300 for fixing the drivers 100 and 200.

In the dynamic driver 100, a yoke 120, which is a portion of a magnetic circuit, is insert-injected into the frame 110, which is a plastic injection material. The yoke 120 has a bottom surface and a side wall bent upward along an outer periphery of the bottom surface. A permanent magnet 130 is attached to the bottom surface of the yoke 120 at a distance from the sidewall, and a plate 140 to help form magnetic flux is attached on the permanent magnet 130. An air gap is formed between the permanent magnet 130 and an outer circumferential surface of the plate 140 and the side wall of the yoke 120, and a lower end of a voice coil 150 is located in the air gap. When an electrical signal is applied to the voice coil 150, the voice coil 150 vibrates by an electromagnetism formed by the voice coil 150 and a mutual electromagnetic force between the permanent magnet 130 and the plate 140. Here, an upper end of the voice coil 150 is attached to a diaphragm 160, and the diaphragm 160 also vibrates with the vibration of the voice coil 150 to generate sound. Meanwhile, a terminal (not shown) capable of transmitting an electrical signal to the voice coil 150 may be coupled to the frame 110 or may be integrally formed by insert injection.

Here, the bracket 300 is coupled to the frame 110 to cover an upper portion of the dynamic driver 100, that is, an upper portion of the diaphragm 160. Here, the bracket 300 includes a sound emission port 310 so as to emit sound generated by the diaphragm 160 of the dynamic driver 100, and in this case, plurality of sound emission ports 310 may be provided as needed.

The balanced armature driver 200 may include a housing 210, a coil 222 installed in the housing 210 and wound around a bobbin (not shown) to generate a magnetic field by a current, a magnetic circuit 221 installed in the housing 210 and having an air gap, an armature 223 having one end inserted into the air gap of the magnetic circuit 221 and the coil 222 and magnetized by a magnetic field of the coil 222 to interact with the magnetic circuit, a rod 224 vertically connected with respect to the armature 223, a diaphragm 225 vibrating by the rod 224, and a pair of terminals 226 electrically connected to the coil 222 and extending to the outside of the housing 210 so as to be directly electrically connected to a flexible circuit board.

Here, a sound emission hole 212 for emitting sound generated by the diaphragm 225 is formed on an upper surface of the housing 210, that is, on a surface facing the diaphragm 225.

A magnetic circuit 221 is installed in front of the coil 222 in the housing 210. The magnetic circuit 221 includes a pair of permanent magnets. The pair of permanent magnets are disposed with an interval up and down therebetween, and one end of the armature 223 is inserted into the interval between the permanent magnets, that is, the air gap between the permanent magnets.

The armature 223 has a U-shape, one end thereof is positioned outside the coil 222 and the magnetic circuit 221, and the other end thereof is inserted into the coil 222 and the magnetic circuit 221. When a current flows through the coil 222, the armature 223 is magnetized, and accordingly, the armature 223 vibrates up and down by mutual electromagnetic force with the magnetic circuit 221. The other end of the armature 223 extends further forwardly than the magnetic circuit 221, and the rod 224 is vertically connected to the extended end.

A lower end of the rod 224 is connected to the armature 223, and an upper end of the rod 224 is connected to the diaphragm 225 so that the diaphragm 225 vibrates together by the rod 224 when the armature 223 vibrates. The diaphragm 225 is formed by bonding a TPU-based film diaphragm and a metal diaphragm, and the metal diaphragm may be formed of aluminum.

The bracket 300 has a shape that may cover an upper portion of the dynamic driver 100 and includes an upper surface 302 formed at a distance from the diaphragm 160 to secure a vibration space of the diaphragm 160 of the dynamic speaker 100 and a side wall 304 supporting the upper surface 302. As described above, the bracket 300 includes the sound emission port 310 to emit sound generated by the diaphragm 160 of the dynamic driver 100, and in this case, a plurality of sound emission ports 310 may be provided as needed. Here, the balanced armature driver 200 is installed on an upper surface of the bracket 300. To this end, the bracket 300 has a balanced armature driver accommodation space 320 on an upper surface thereof. Here, the balanced armature driver 200 is disposed such that the diaphragm 225 is parallel to the upper surface 302 of the bracket 300. Here, being parallel does not mean perfect geometrical parallelism but that a direction that may be admitted as an arrangement direction of the upper surface of the bracket 300 and a direction that may be admitted as an arrangement direction of the diaphragm 225 of the balanced armature driver 200 are parallel to each other although there is an uneven portion or a bent portion on the upper surface 302 of the bracket 300.

Accordingly, a propagation direction of sound emitted from the sound emission hole 212 formed on the upper surface of the housing 210 of the balanced armature driver 200 is the same as a propagation direction of sound emitted from the sound emission hole 310 formed in the bracket 300.

In other words, a shape of the outer surface of the balanced armature driver 200, that is, a shape of the housing 210, is generally a rectangular parallelepiped shape. Here, a side having the largest area, among six sides of the housing 210 of the balanced armature driver 200, is fixed to the bracket 300. Here, there are two surfaces having the same area, of which a surface close the diaphragm 225 has the sound emission hole 212 and the opposite surface of the diaphragm 225 is fixed to the upper surface 302 of the bracket 300.

Meanwhile, the bracket 300 may have an air pressure balancing hole 340 on the upper surface 302 on an outer side of the dynamic driver 100. The air pressure balancing hole 340 allows air flow between the front and rear of the hybrid receiver when the hybrid receiver is applied to a sealed earphone, thereby reducing a pressure difference between the ear canal and the outside to reduce ear pain. Here, a mesh 342 may be attached to the air pressure balancing hole 340, and the amount of ventilation and the degree of sound insulation may be adjusted by adjusting air permeability of the mesh 342.

In addition, it may further include a flexible circuit board 400 for transmitting an electrical signal to each of the drivers 100 and 200. In this case, there is an advantage in that the number of components may be reduced and the structure may be simplified by connecting all terminals (not shown, 226) of the drivers 100 and 200 to the single flexible circuit board 400. Here, the flexible circuit board 400 may be fixed to the bracket 300 by a separate fixing member or a bonding member.

In the case of a hybrid receiver, since different drivers 100 and 200 have separate magnetic circuits 120, 130, 140, and 221, respectively, mutual interference occurs between the magnetic fields of the drivers 100 and 200, which significantly affects lowering of sound pressure of the balanced armature driver 200. To this end, a direction of magnetic polarity of the magnetic circuit 221 of the balanced armature driver 200 should match the polarity of the permanent magnet 130 of the dynamic driver 100. In this case, in order to minimize magnetic field interference between the drivers 100 and 200, a shielding member 330 for shielding magnetism may be installed between the dynamic driver 100 and the balanced armature driver 200. The shielding member 330 provided in the hybrid receiver according to the first embodiment of the present disclosure is of a panel type and is inserted into and fixed to the bracket 300. The shielding member 320 is manufactured using a plate material having high magnetic permeability, for example, pure iron, steel, soft iron, or the like.

Figure 4:
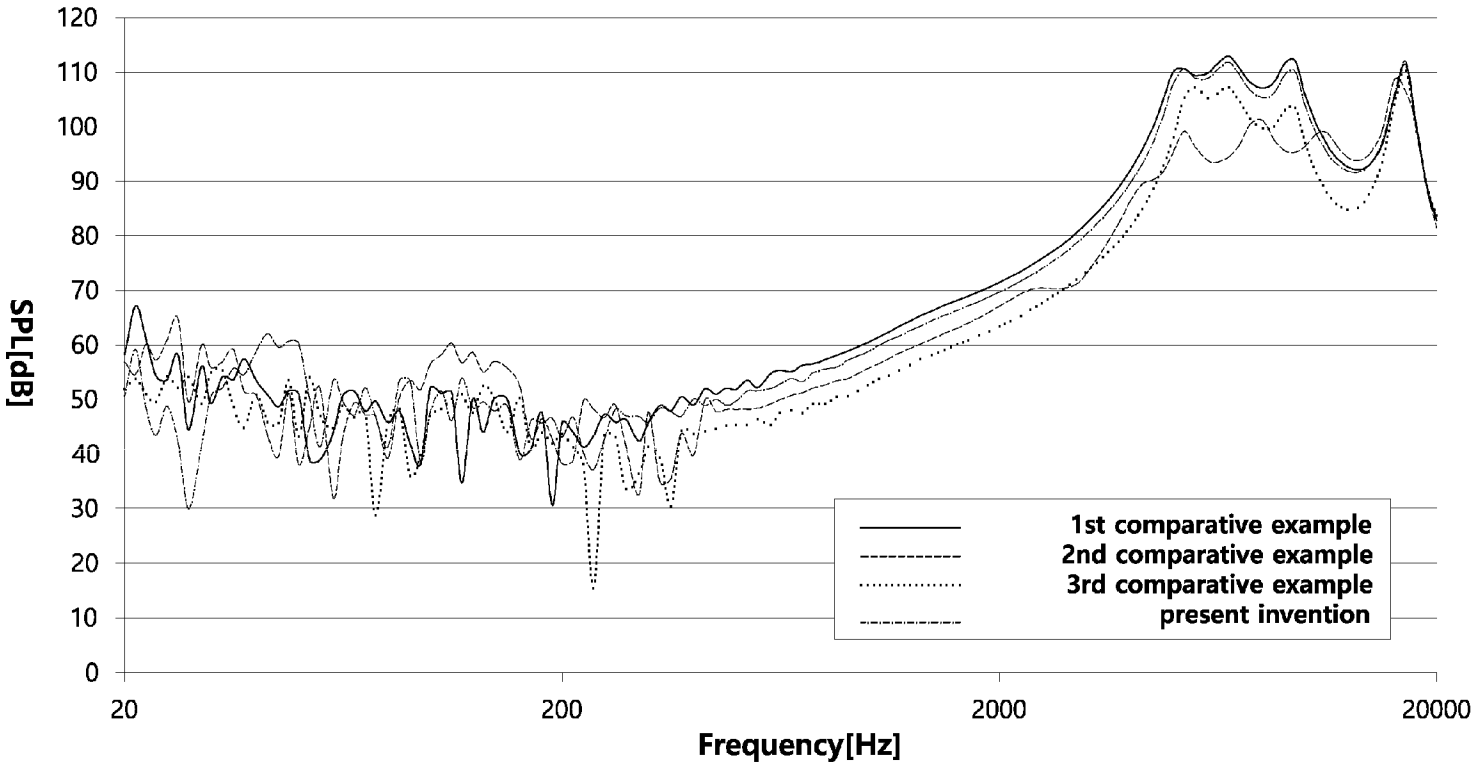
FIG. 4 is a graph showing comparison between sound pressures of a balanced armature driver of a hybrid receiver having a fixing bracket for drivers according to the first embodiment of the present disclosure and a balanced armature driver of a receiver in which a shielding member is not installed.

FIG. 4 is a graph showing comparison between sound pressures of a balanced armature driver of a hybrid receiver having a fixing bracket for drivers according to the first embodiment of the present disclosure and a balanced armature driver of a receiver in which a shielding member is not installed. The sound pressures of the first embodiment of the present disclosure shown in FIG. 2 and comparative examples 1 to 3 shown in FIGS. 5 to 7 are compared.

Figure 5:
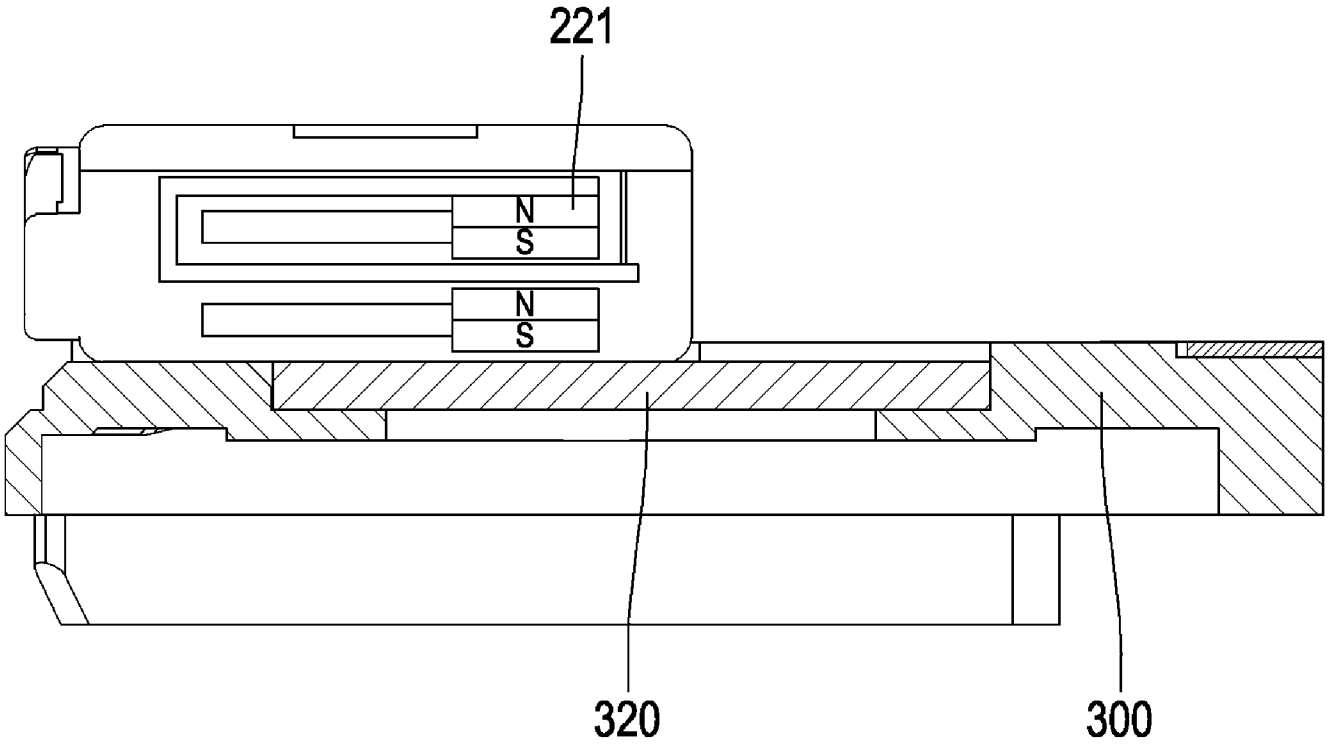
FIG. 5 is a cross-sectional view of a first comparative example in which only a balanced armature driver is installed on a fixing bracket for drivers.

FIG. 5 is a cross-sectional view of a first comparative example in which only a balanced armature driver is installed on a fixing bracket for drivers. By installing only the balanced armature driver 200 in the fixing bracket 300 for drivers, a sound pressure of the balanced armature driver 200 when a magnetic field of the dynamic driver does not affect it may be measured. Here, the balanced armature driver 200 includes the magnetic circuit 221 including a pair of permanent magnets as described above, and a yoke that helps a magnetic flux flow is attached to a lower surface of the lower permanent magnet and an upper surface of the upper permanent magnet. Here, polarity arrangements of the upper permanent magnet and the lower permanent magnet may be the same. That is, when the N pole of the upper permanent magnet is disposed on the upper side and the S pole thereof is disposed on the lower side, the N pole of the lower permanent magnet is disposed on the upper side and the S pole thereof is disposed on the lower side.

Figure 6:
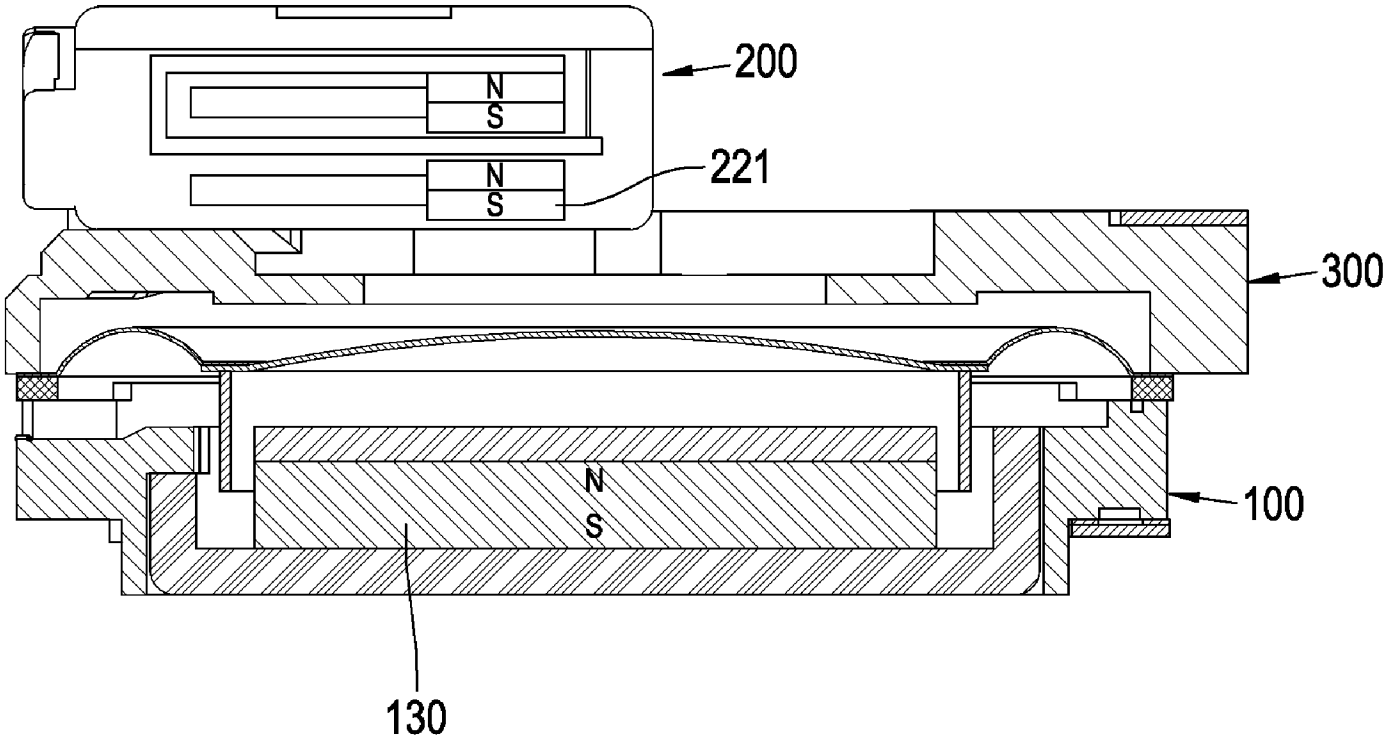
FIG. 6 is a cross-sectional view of a second comparative example in which polarities of magnetic circuits of a balanced armature driver and a dynamic driver are arranged in the same direction without installing a shielding member in a fixing bracket for drivers.

FIG. 6 is a cross-sectional view of a second comparative example in which polarities of magnetic circuits of a balanced armature driver and a dynamic driver are arranged in the same direction without installing a shielding member in a fixing bracket for drivers. Both the balanced armature driver 200 and the dynamic driver 100 were installed in the fixing bracket 300 for drivers. Here, a separate shielding member for shielding a magnetic field of the dynamic driver 100 was not installed in the fixing bracket 300 for drivers. In addition, a polarity direction of the permanent magnet 130 installed in the dynamic driver 100 matched a polarity direction of the magnetic circuit 221 of the balanced armature driver 200. That is, as in the first comparative example, the balanced armature driver 200 includes the magnetic circuit 221 including a pair of permanent magnets as described above, the upper permanent magnet and the lower permanent magnet have the same polarity arrangement, and also, a polarity arrangement of the permanent magnet 130 of the dynamic driver 100 is also made in the same manner. That is, when a N pole is disposed at the upper portion of the upper permanent magnet and an S pole is disposed at the lower portion, an N pole is disposed at an upper portion of the lower permanent magnet and an S pole is disposed at a lower portion thereof, and an N pole is disposed at an upper portion of the dynamic driver 100, and an S pole thereof is disposed at a lower portion.

Figure 7:
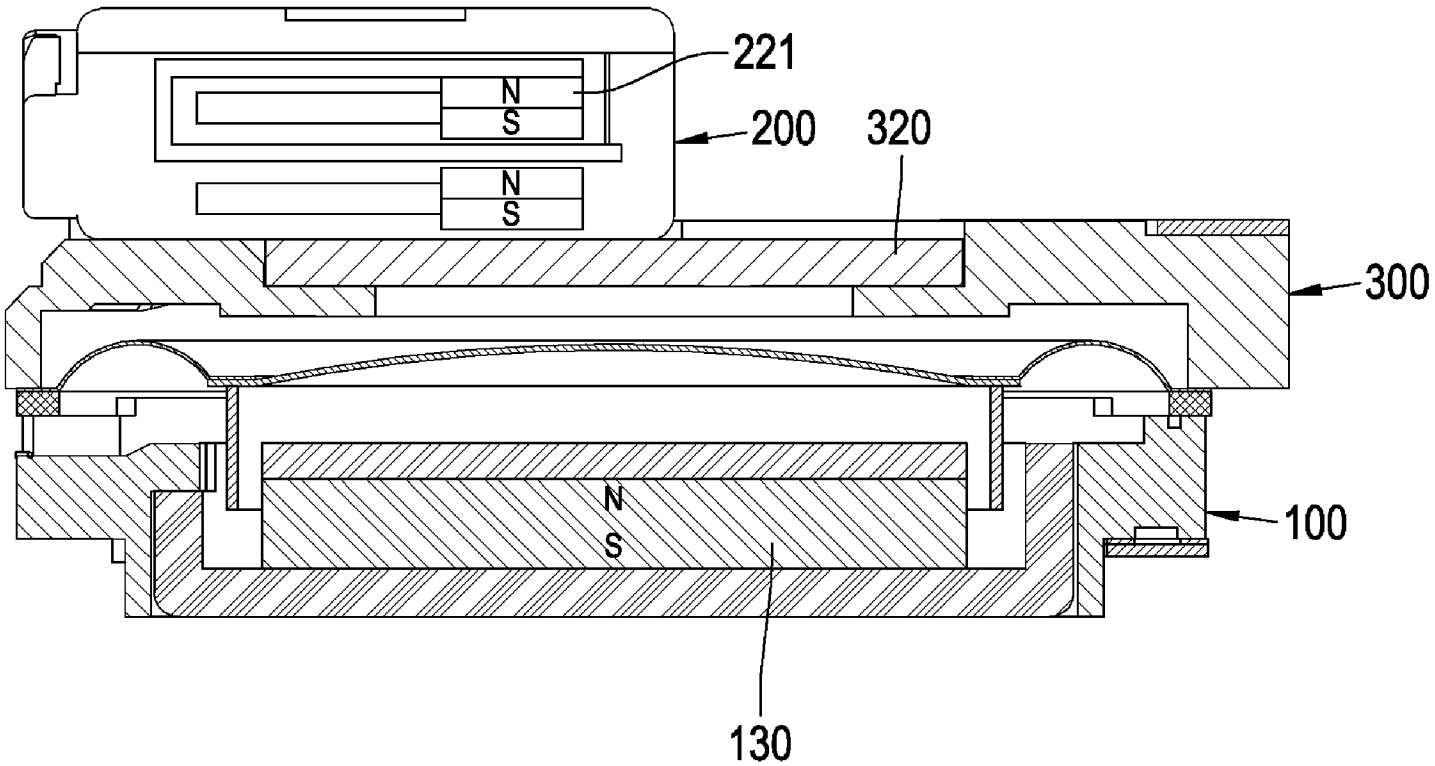
FIG. 7 is a cross-sectional view of a third comparative example in which a shielding member is installed on a fixing bracket for drivers and polarities of magnetic circuits of a balanced armature driver and a dynamic driver are arranged in opposite directions.

FIG. 7 is a cross-sectional view of a third comparative example in which a shielding member is installed on a fixing bracket for drivers and polarities of magnetic circuits of a balanced armature driver and a dynamic driver are arranged in opposite directions.

Both the balanced armature driver 200 and the dynamic driver 100 were installed in the fixing bracket 300 for drivers. Here, a shielding member 320 for shielding a magnetic field of the dynamic driver 100 was installed in the fixing bracket 300 for drivers. In addition, a polarity direction of the permanent magnet 130 installed in the dynamic driver 100 was the opposite to a polarity direction of the magnetic circuit 221 of the balanced armature driver 200. That is, as in the first comparative example, the balanced armature driver 200 includes the magnetic circuit 221 including a pair of permanent magnets as described above, the upper permanent magnet and the lower permanent magnet have the same polarity arrangement, and the permanent magnet 130 of the dynamic driver 100 and the magnetic circuit 221 of the balanced armature driver 200 are arranged to have mutually opposite polarities. That is, when a N pole is disposed at the upper portion of the upper permanent magnet and an S pole is disposed at the lower portion, an N pole is disposed at an upper portion of the lower permanent magnet and an S pole is disposed at a lower portion thereof, and conversely, an S pole is disposed at an upper portion of the dynamic driver 100, and an N pole thereof is disposed at a lower portion.

In addition, the hybrid receiver according to an embodiment of the present disclosure is based on the first embodiment of the present disclosure shown in FIG. 2. According to the first embodiment of the present disclosure, the shielding member 320 is installed on the bracket 300, and the permanent magnet 130 of the dynamic driver 100 and the magnetic circuit 221 of the balanced armature driver 200 are arranged to have the same polarity.

Sound pressures of the balanced armature driver of first comparative example (BA only) in which only a balanced armature driver of the same specification is installed on the bracket without a dynamic driver, second comparative example (non-shield+positive polarity disposition) in which polarities of magnetic circuits of the balanced armature driver and the dynamic driver are arranged in the same direction without a shielding member, third comparative example (in-shield+negative polarity disposition) in which polarities of magnetic circuits of the balanced armature driver and the dynamic driver are arranged in the opposite directions with a shielding member, and an example of the present disclosure in which polarities of magnetic circuits of the balanced armature driver and the dynamic driver are arranged in the same direction with a shielding member were measured.

As a result, it can be seen that, the sound pressure of the balanced armature driver according to the embodiment of the present disclosure in the high sound range is almost similar to the sound pressure of the balanced armature driver in which the dynamic driver is not installed and there is almost no loss due to mutual magnetic field interference.

Figure 8:
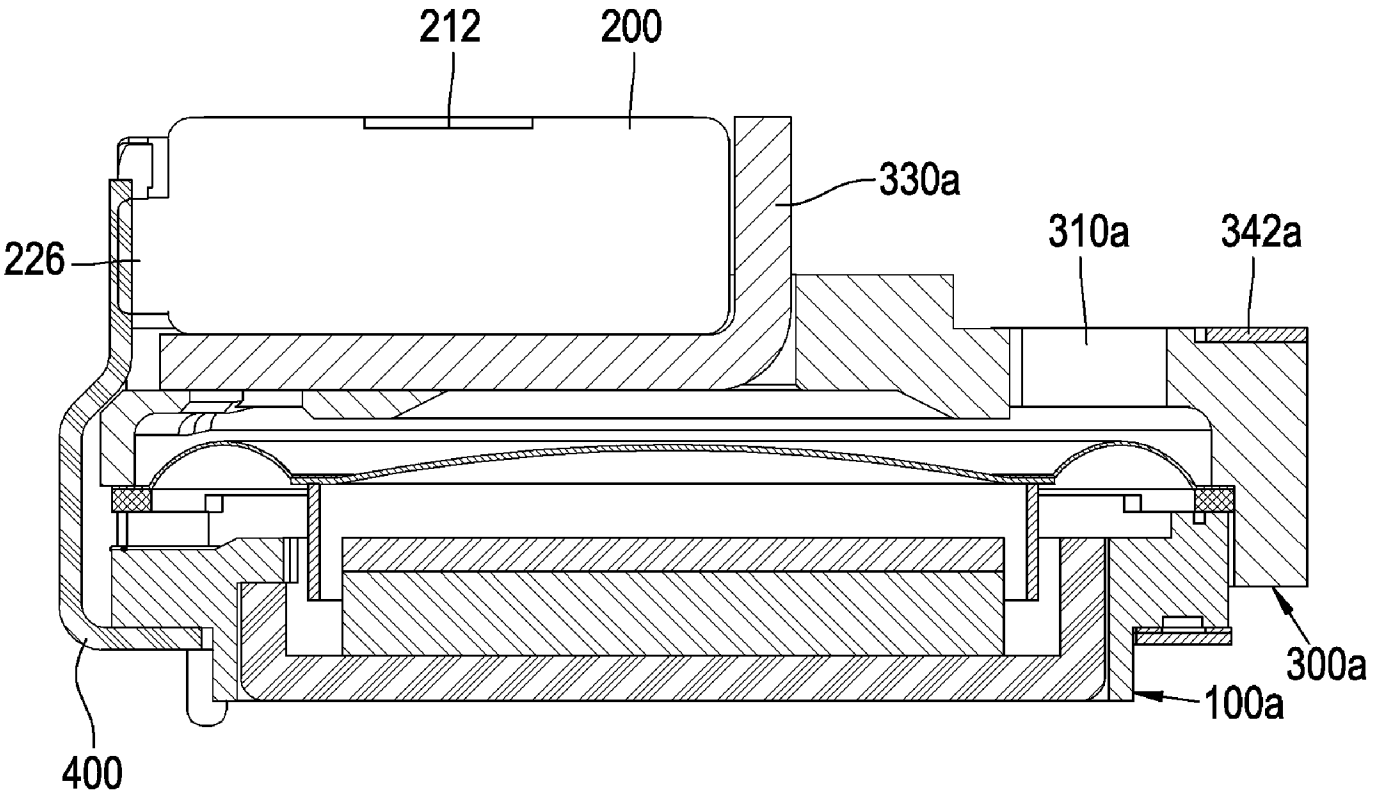
FIG. 8 is a cross-sectional view of a hybrid receiver having a fixing bracket for drivers according to a second embodiment of the present disclosure.
Figure 9:
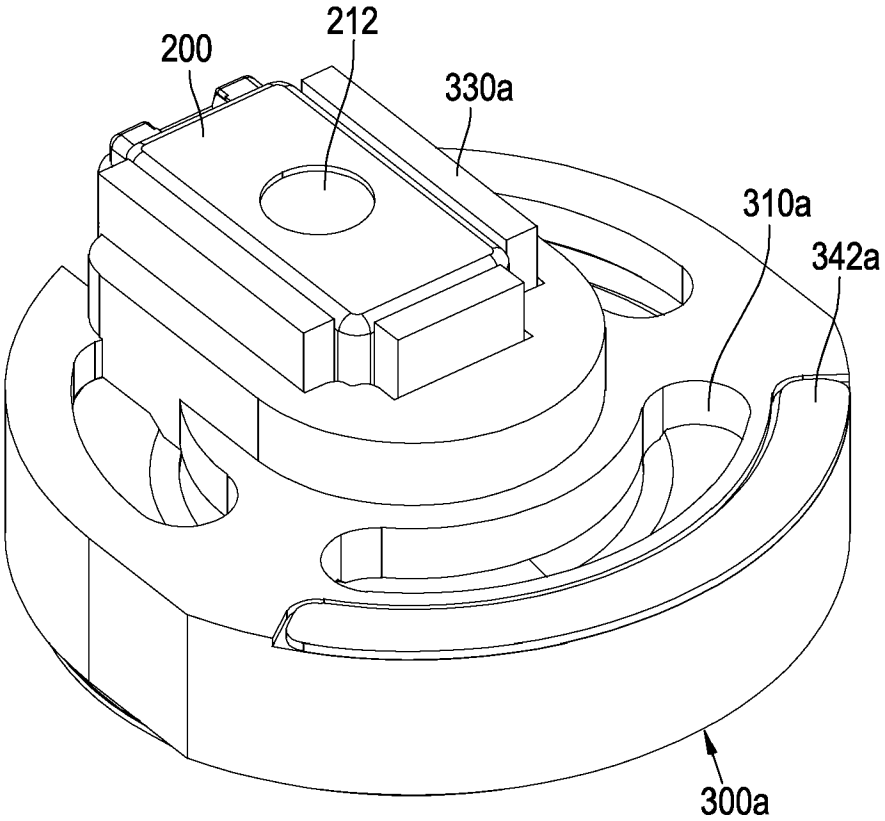
FIG. 9 is a perspective view of a hybrid receiver having a fixing bracket for drivers according to a second embodiment of the present disclosure.

FIG. 8 is a cross-sectional view of a hybrid receiver having a fixing bracket for drivers according to a second embodiment of the present disclosure, and FIG. 9 is a perspective view of a hybrid receiver having a fixing bracket for drivers according to a second embodiment of the present disclosure.

The hybrid receiver according to the second embodiment of the present disclosure has the same functions and arrangement of the components as those of the first embodiment except for a shape of a shielding member 330*a* and a shape of a coupling portion of a bracket 300*a* coupled to the shielding member 330*a*. Therefore, a repeated description thereof is omitted.

In the hybrid receiver according to the second embodiment of the present disclosure, the magnetic shielding member 330*a* for preventing mutual interference of magnetic fields between the dynamic driver 100 and the balanced armature driver 200 is a can type surrounding the balanced armature driver 200.

As described above, an external shape of the balanced armature driver 200 is approximately a rectangular parallelepiped. In this case, the magnetic shielding member 330*a* has a shape surrounding a lower surface and three side surfaces of the balanced armature driver 200. A terminal 226 for transmitting an electrical signal to a coil is generally disposed on a surface having the narrowest area, among six surfaces of the balanced armature driver 200. Here, the balanced armature driver 200 is disposed so that the terminal 226 is located on the side closer to the outer periphery of the bracket 300*a*. The magnetic shielding member 330*a* surrounds the remaining four surfaces of the balanced armature driver 200 except for the upper surface on which the sound emission hole 212 of the balanced armature driver 200 is formed and one side surface on which the terminal 226 is formed. That is, it covers the lower surface and three side surfaces. Accordingly, mutual magnetic field interference with the dynamic driver 100 may be further minimized.

The balanced armature driver 200 is installed on the bracket 300*a* in a state in which the can-type magnetic shielding member 330*a* is coupled to the balanced armature driver 200. Accordingly, the balanced armature driver accommodation space of the bracket 300*a* has a shape corresponding to the magnetic shielding member 330*a*.

Figure 10:
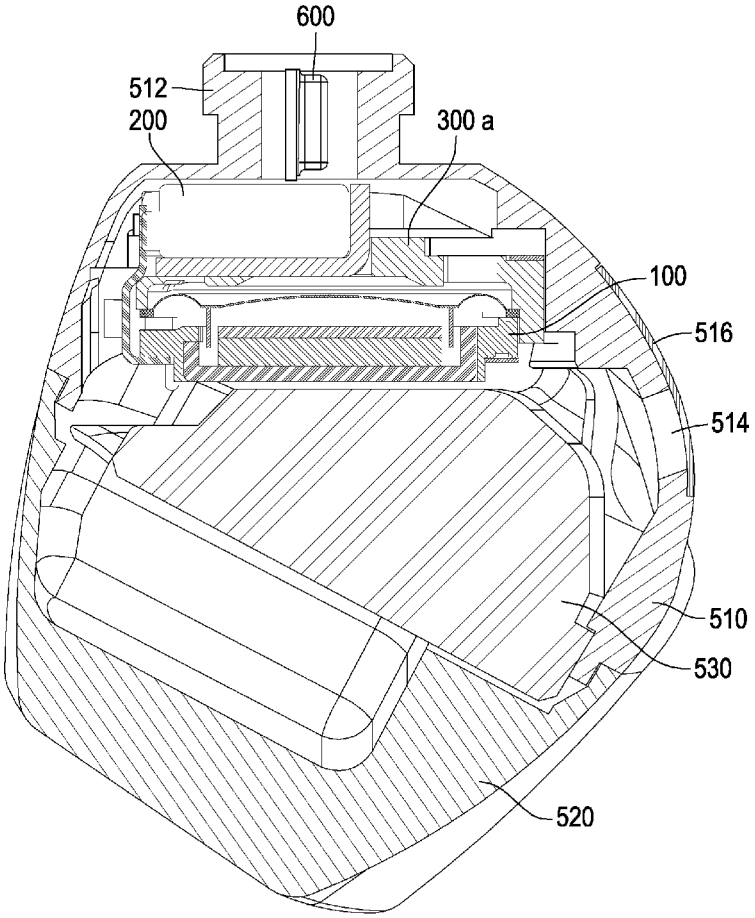
FIG. 10 is a view illustrating an earphone equipped with a hybrid receiver having a fixing bracket for drivers according to the second embodiment of the present disclosure.

FIG. 10 is a view illustrating an earphone equipped with a hybrid receiver having a fixing bracket for drivers according to the second embodiment of the present disclosure. Referring to FIGS. 8 to 10, the dynamic driver 100 and the balanced armature driver 200 coupled to the bracket 300*a* are installed in the housing 510 of the earphone. A first cover 520 is coupled to the rear of the housing 510, and in some cases, a second cover 530 may be additionally provided between the first cover 520 and the housing 510 to fix the hybrid receiver. The housing 510 may include a sound tube 512 on an upper side of the hybrid receiver for emitting sound of the hybrid receiver. In addition, a vent hole 514 communicating with the outside is formed in a lower space of the hybrid receiver. A mesh 516 is attached to the vent hole 514, and acoustic characteristics may be tuned by adjusting air permeability of the mesh 516.

Meanwhile, when the earphone has an ANC function, a feedback microphone 600 may be disposed in the sound tube 512.

That is, as the installation position of the balanced armature driver 200 is changed to the upper surface of the bracket 300*a*, the feedback microphone 600 may be installed in the sound tube 512, and since the size of the feedback microphone 600 is relatively small, compared with the balanced armature driver 200, a length of the sound tube 512 may be reduced. In addition, disposing the feedback microphone 600 in the sound tube 512 having the same diameter is advantageous in securing a duct area for emitting sound of the dynamic driver 100, compared to disposing the balanced armature driver 200.

In addition, since the dynamic driver 100 and the balanced armature driver 200 are assembled in the housing 510 of the earphone in a state in which positions thereof in the bracket 300*a* are determined, the dynamic driver 100 and the balanced armature driver 200 may be assembled in accurate positions. Therefore, a relative positional deviation between the dynamic driver 100 and the balanced armature driver 200 during the assembly process may be reduced. Since the relative positions of the dynamic driver 100 and the balanced armature driver 200 are fixed, an acoustic phase deviation due to the positional deviation between the dynamic driver 100 and the balanced armature driver 200 may be prevented.

In addition, since the respective drivers 100 and 200 are assembled before they are assembled in the housing 510, there is an advantage in that acoustic characteristics may be known in advance. After assembling the drivers 100 and 200 are assembled to the bracket 300*a* first, the acoustic characteristics may be determined in advance, and thus, a final defect rate may be lowered.

Figure 11:
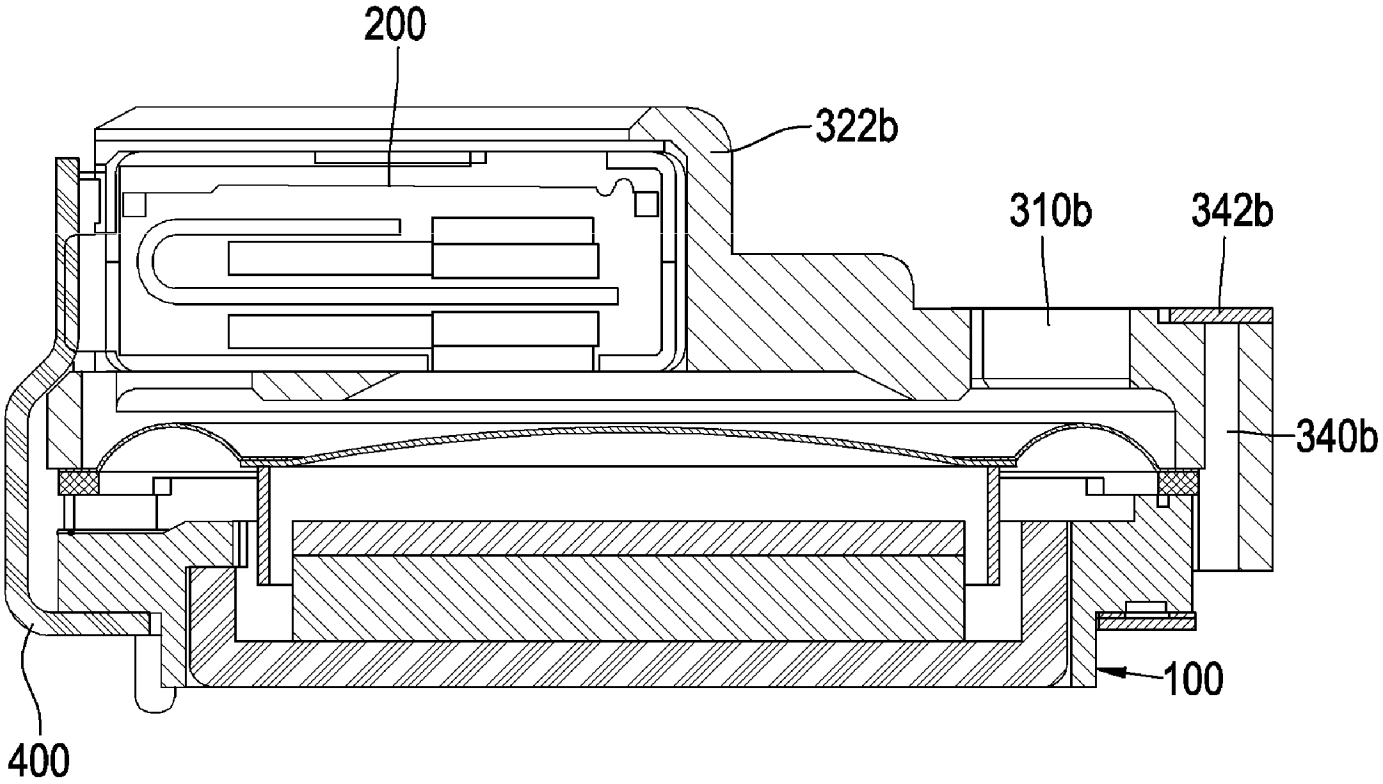
FIG. 11 is a cross-sectional view of a hybrid receiver having a fixing bracket for drivers according to a third embodiment of the present disclosure.
Figure 12:
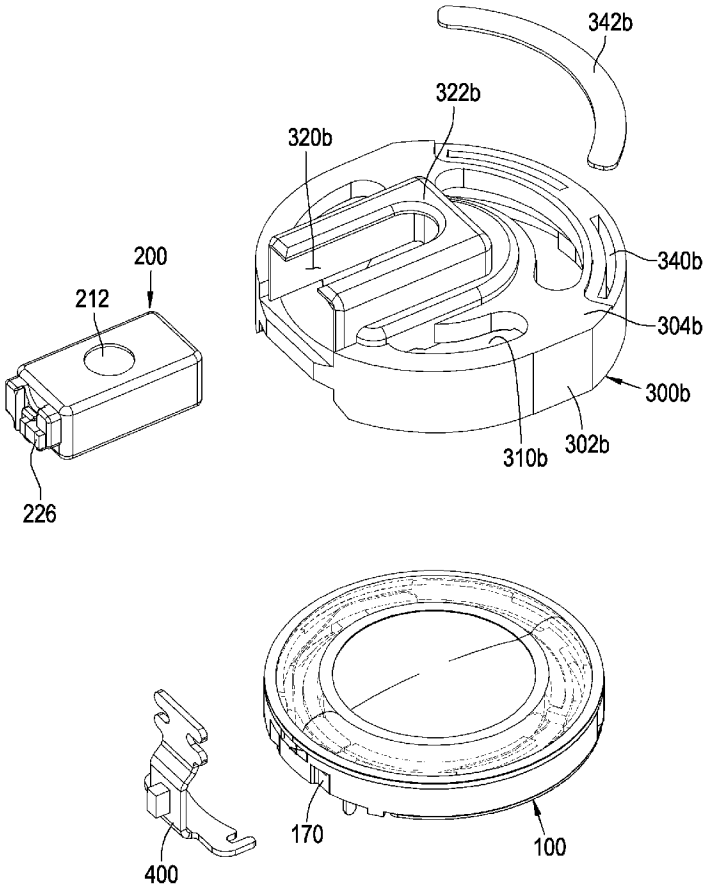
FIG. 12 is an exploded view of a hybrid receiver having a fixing bracket for drivers according to the third embodiment of the present disclosure.
Figure 13:
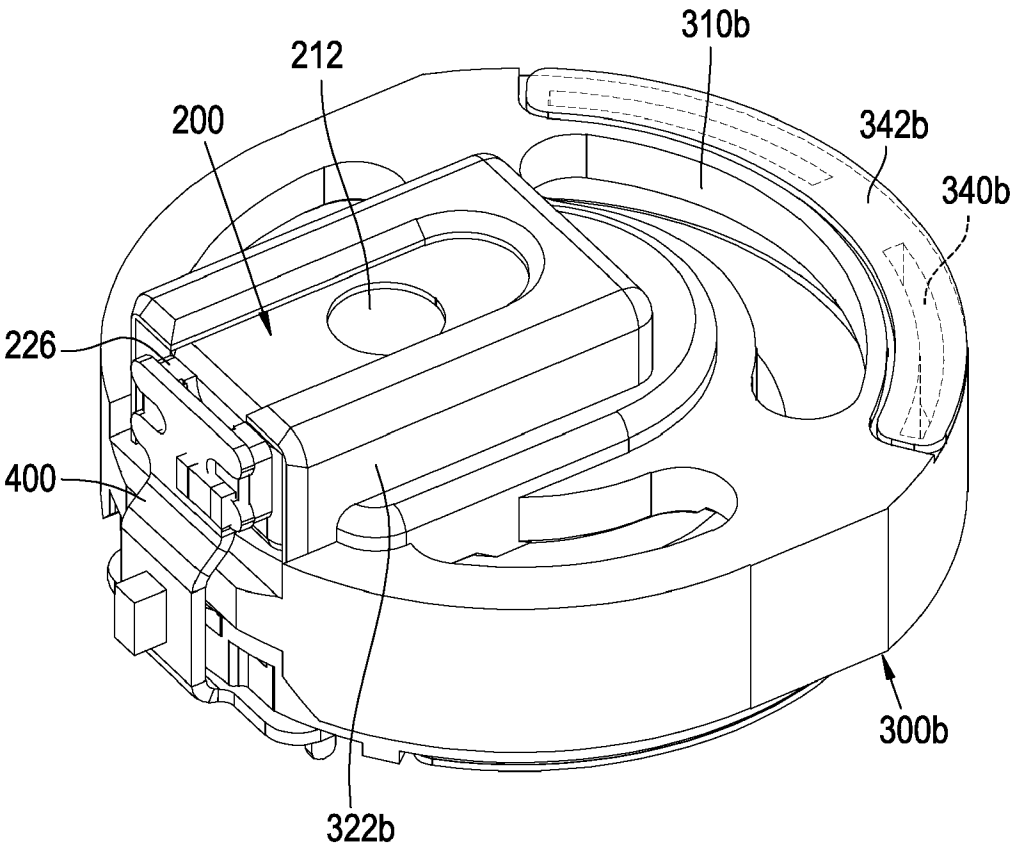
FIG. 13 is a perspective view of a hybrid receiver having a fixing bracket for drivers according to the third embodiment of the present disclosure.

FIG. 11 is a cross-sectional view of a hybrid receiver having a fixing bracket for drivers according to a third embodiment of the present disclosure, FIG. 12 is an exploded view of a hybrid receiver having a fixing bracket for drivers according to the third embodiment of the present disclosure, and FIG. 13 is a perspective view of a hybrid receiver having a fixing bracket for drivers according to the third embodiment of the present disclosure.

The hybrid receiver having a fixing bracket according to the third embodiment of the present disclosure is the same as the first embodiment, except for a coupling structure of the bracket 300*b* and the balanced armature driver 200. Thus, a description of the same structure is omitted.

As described above, the dynamic driver 100 and the balanced armature driver 200 include a voice coil and terminals 170 and 226 for transmitting electrical signals to the coil, respectively. Here, the terminal 170 of the dynamic driver 100 and the terminal 226 of the balanced armature driver 200 are aligned to be positioned in the same direction. Accordingly, it is easy to install the flexible circuit board 400 electrically connected to the terminal 170 of the dynamic driver 100 and the terminal 226 of the balanced armature driver 200. In addition, when only one flexible circuit board 400 is electrically connected to both the terminal 170 of the dynamic driver 100 and the terminal 226 of the balanced armature driver 200, a size of the flexible circuit board 400 may be minimized.

In addition, as described above, the balanced armature driver 200 is a hexahedron, and the largest surface thereof is installed parallel to the upper surface of the bracket 300*b*. Here, the sound emission hole 212 is formed on the upper surface of the balanced armature driver 200. Here, in the bracket 300*b*, an accommodation space 320*b* for accommodating the balanced armature driver 200 is formed to protrude. The accommodation space 320*b* is defined by a cover portion 322*b* protruding from the upper surface of the bracket 300*b*, and the cover portion 322*b* surrounds three side surfaces and at least a portion of an upper surface of the balanced armature driver 200. That is, the cover portion 322*b* covers the remaining three side surfaces of the balanced armature driver 200 except for a side surface on which the terminal 226 is formed and covers the upper surface of the balanced armature driver 200 but does not cover the sound emission hole 312.

The cover portion 322*b* may surround an outer surface of the balanced armature driver 200 to protect the balanced armature driver 200 vulnerable to impact.

Figure 14:
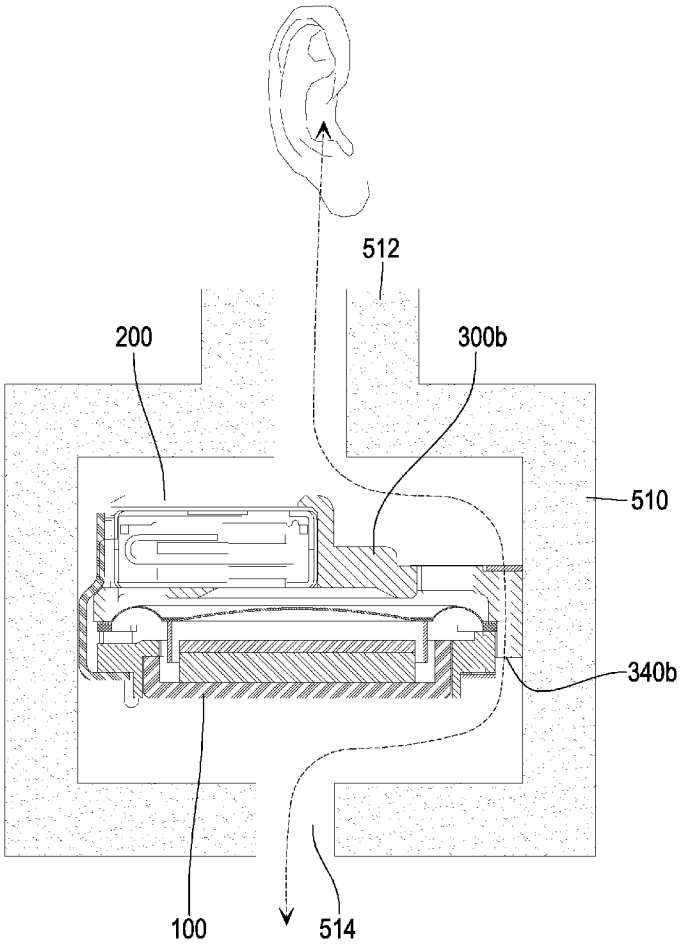
FIG. 14 is a cross-sectional view schematically illustrating an earphone equipped with a hybrid receiver having a fixing bracket for drivers according to the third embodiment of the present disclosure.

FIG. 14 is a cross-sectional view schematically illustrating an earphone equipped with a hybrid receiver having a fixing bracket for drivers according to the third embodiment of the present disclosure. Referring to FIGS. 11 to 14, when the hybrid receiver is installed in the housing 510, an upper space of the hybrid receiver and a lower space of the hybrid receiver are blocked by the hybrid receiver. As a result, an air flow between the upper and lower spaces of the hybrid receiver is blocked and a pressure difference occurs between the inside of the ear canal in which the earphone is worn and the outside blocked by the earphone when in use, resulting in deafening and concentration of fatigue on the eardrum.

In the hybrid receiver according to the present disclosure, as described above, the bracket 300*b* may have an air pressure balancing hole 340*b* on the outside of the dynamic driver 100. The air pressure balancing hole 340*b* allows air flow between the upper and lower portions of the hybrid receiver when the hybrid receiver is applied to the sealed earphone, thereby reducing a pressure difference between the ear canal and the outside to reduce ear pain. Here, the mesh 342 may be attached to the air pressure balancing hole 340*b*, and the ventilation amount and the degree of sound insulation may be adjusted by adjusting the air permeability of the mesh 342.

A vent hole 514 communicating with the outside is formed in the housing 510 defining a lower space of the hybrid receiver. In this case, a mesh (not shown) may also be attached to the vent hole 514, and acoustic characteristics may be tuned by adjusting air permeability of the mesh (not shown).

Figure 15:
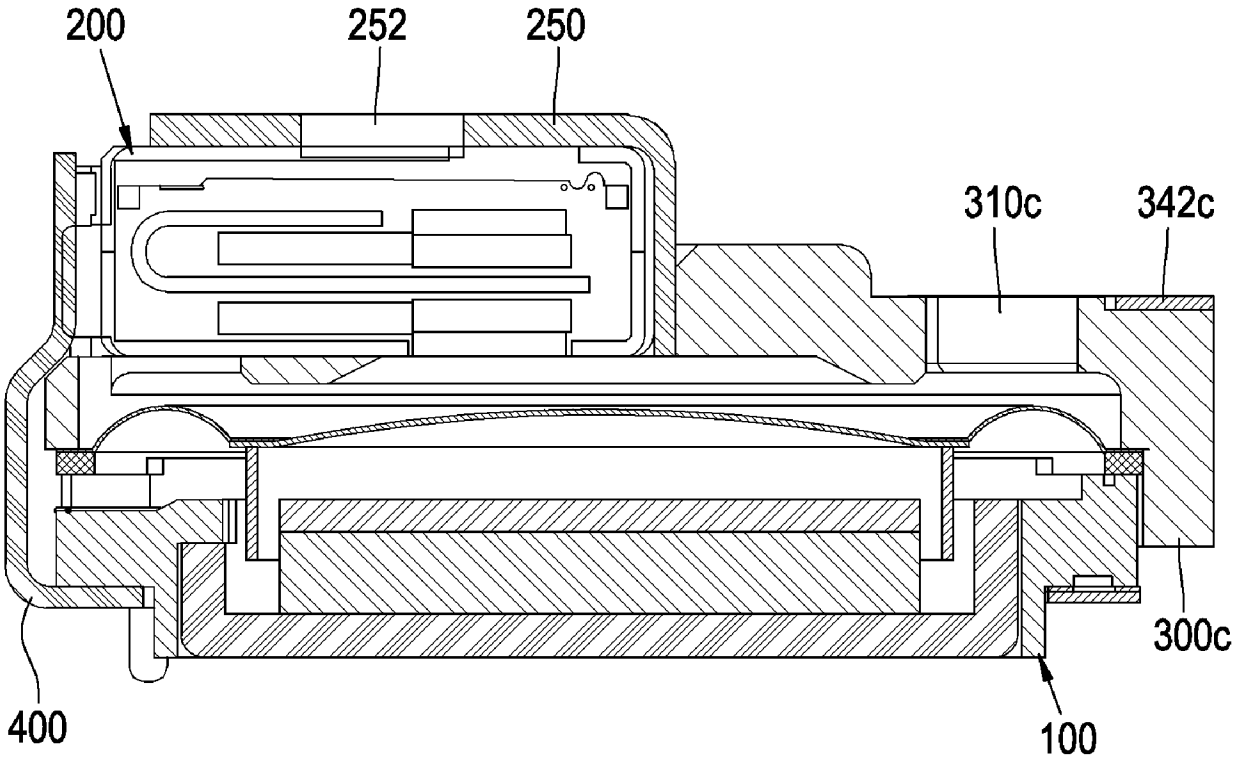
FIG. 15 is a cross-sectional view of a hybrid receiver having a fixing bracket for drivers according to a fourth embodiment of the present disclosure.
Figure 16:
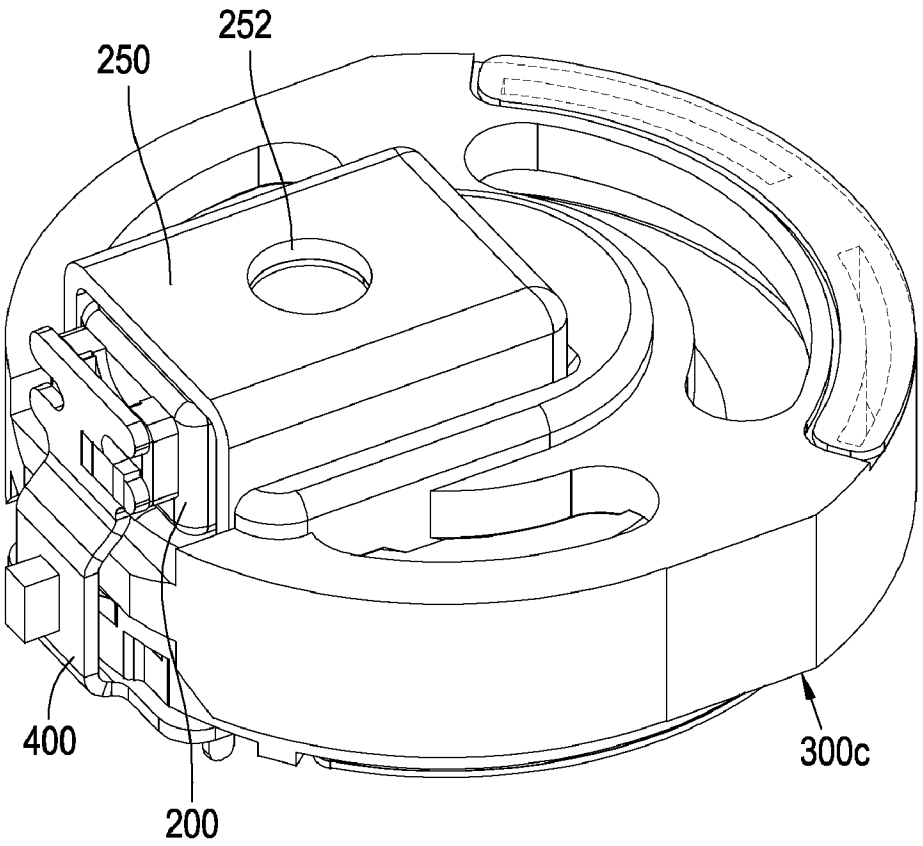
FIG. 16 is a perspective view of a hybrid receiver having a fixing bracket for drivers according to the fourth embodiment of the present disclosure.

FIG. 15 is a cross-sectional view of a hybrid receiver having a fixing bracket for drivers according to a fourth embodiment of the present disclosure and FIG. 16 is a perspective view of a hybrid receiver having a fixing bracket for drivers according to the fourth embodiment of the present disclosure.

The hybrid receiver according to the fourth embodiment of the present disclosure is the same as the third embodiment except that the component serving as the cover portion in the third embodiment is formed separately as a separate member. Therefore, descriptions of the same components are omitted to avoid redundant descriptions.

The hybrid receiver according to the fourth embodiment of the present disclosure further includes a protective cap 250 surrounding an outer surface of the balanced armature driver 200. The protective cap 250 covers three side surfaces and an upper surface of the balanced armature driver 200 except for a surface on which the terminal is formed, but may cover five surfaces up to a lower surface. The protective cap 250 may have a hole 252 in a position corresponding to the sound emission hole of the balanced armature driver 200 to emit sound generated by the balanced armature driver 200.

The balanced armature driver 200 is fixed to a bracket 300*c* with the protective cap 250 coupled thereto. In this case, the protective cap 250 may be formed of a material capable of absorbing an impact, such as rubber, soft plastic, or silicone.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A hybrid receiver having a fixing bracket for drivers and including a combination of different types of drivers, the hybrid receiver comprising:
- a dynamic driver including a frame, a magnetic circuit, a voice coil vibrated by the magnetic circuit and a mutual electromagnetic force, and a diaphragm to which the voice coil is attached to vibrate;
- a balanced armature driver including a housing, a magnetic circuit, a coil, an armature magnetized by a magnetic field of the coil to interact with the magnetic circuit, a rod vertically connected to the armature, and a diaphragm vibrated by the rod;
- a bracket coupled to an upper portion of the diaphragm of the dynamic driver and having a sound emission port configured to emit sound of the dynamic driver, wherein the bracket has a balanced armature driver accommodation space on an upper surface thereof, the balanced armature driver is disposed such that the diaphragm is parallel to the upper surface of the bracket, and the housing has a sound emission hole above the diaphragm; and
- a shielding member installed between the balanced armature driver and the dynamic driver and configured to shield magnetism.

2. The hybrid receiver of claim 1, wherein the shielding member is installed on the upper surface of the bracket.

3. The hybrid receiver of claim 1, wherein the shielding member surrounds the balanced armature driver.

4. A hybrid receiver having a fixing bracket for drivers and including a combination of different types of drivers, the hybrid receiver comprising:
- a dynamic driver including a frame, a magnetic circuit, a voice coil vibrated by the magnetic circuit and a mutual electromagnetic force, and a diaphragm to which the voice coil is attached to vibrate;
- a balanced armature driver including a housing, a magnetic circuit, a coil, an armature magnetized by a magnetic field of the coil to interact with the magnetic circuit, a rod vertically connected to the armature, and a diaphragm vibrated by the rod;
- a bracket coupled to an upper portion of the diaphragm of the dynamic driver and having a sound emission port configured to emit sound of the dynamic driver,
- wherein the bracket has a balanced armature driver accommodation space on an upper surface thereof, the balanced armature driver is disposed such that the diaphragm is parallel to the upper surface of the bracket, and the housing has a sound emission hole above the diaphragm,
- wherein the dynamic driver and the balanced armature driver are arranged such that magnetic polarity directions thereof match.

5. A hybrid receiver having a fixing bracket for drivers and including a combination of different types of drivers, the hybrid receiver comprising:
- a dynamic driver including a frame, a magnetic circuit, a voice coil vibrated by the magnetic circuit and a mutual electromagnetic force, and a diaphragm to which the voice coil is attached to vibrate;
- a balanced armature driver including a housing, a magnetic circuit, a coil, an armature magnetized by a magnetic field of the coil to interact with the magnetic circuit, a rod vertically connected to the armature, and a diaphragm vibrated by the rod;
- a bracket coupled to an upper portion of the diaphragm of the dynamic driver and having a sound emission port configured to emit sound of the dynamic driver,
- wherein the bracket has a balanced armature driver accommodation space on an upper surface thereof, the balanced armature driver is disposed such that the diaphragm is parallel to the upper surface of the bracket, and the housing has a sound emission hole above the diaphragm,
- wherein the bracket has an air pressure balancing hole communicating with a rear space of the dynamic driver on an outer side of the dynamic driver.

6. The hybrid receiver of claim 5, further comprising:
- a mesh attached to the air pressure balancing hole.

7. A hybrid receiver having a fixing bracket for drivers and including a combination of different types of drivers, the hybrid receiver comprising:
- a dynamic driver including a frame, a magnetic circuit, a voice coil vibrated by the magnetic circuit and a mutual electromagnetic force, and a diaphragm to which the voice coil is attached to vibrate;
- a balanced armature driver including a housing, a magnetic circuit, a coil, an armature magnetized by a magnetic field of the coil to interact with the magnetic circuit, a rod vertically connected to the armature, and a diaphragm vibrated by the rod;
- a bracket coupled to an upper portion of the diaphragm of the dynamic driver and having a sound emission port configured to emit sound of the dynamic driver,
- wherein the bracket has a balanced armature driver accommodation space on an upper surface thereof, the balanced armature driver is disposed such that the diaphragm is parallel to the upper surface of the bracket, and the housing has a sound emission hole above the diaphragm,
- wherein the dynamic driver and the balanced armature driver each include a terminal for transmitting an electrical signal to the voice coil and a coil, and
- wherein the terminal of the dynamic driver and the terminal of the balanced armature driver are aligned to be positioned in the same direction.

8. The hybrid receiver of claim 7, further comprising:

a flexible circuit board electrically connected to the terminal of the dynamic driver and the terminal of the balanced armature driver and fixed to the bracket.

9. A hybrid receiver having a fixing bracket for drivers and including a combination of different types of drivers, the hybrid receiver comprising:

a dynamic driver including a frame, a magnetic circuit, a voice coil vibrated by the magnetic circuit and a mutual electromagnetic force, and a diaphragm to which the voice coil is attached to vibrate;

a balanced armature driver including a housing, a magnetic circuit, a coil, an armature magnetized by a magnetic field of the coil to interact with the magnetic circuit, a rod vertically connected to the armature, and a diaphragm vibrated by the rod; and a bracket coupled to an upper portion of the diaphragm of the dynamic driver and having a sound emission port configured to emit sound of the dynamic driver, wherein the bracket has a balanced armature driver accommodation space on an upper surface thereof, the balanced armature driver is disposed such that the diaphragm is parallel to the upper surface of the bracket, and the housing has a sound emission hole above the diaphragm, wherein a terminal of the balanced armature driver transmitting an electrical signal to the coil is installed on a side surface close to a periphery of the bracket, wherein the bracket surrounds an outer surface of the housing of the balanced armature driver, and wherein the terminal of the balanced armature driver and the sound emission hole of the housing are exposed to the outside of the bracket.

10. A hybrid receiver having a fixing bracket for drivers and including a combination of different types of drivers, the hybrid receiver comprising:

a dynamic driver including a frame, a magnetic circuit, a voice coil vibrated by the magnetic circuit and a mutual electromagnetic force, and a diaphragm to which the voice coil is attached to vibrate;

a balanced armature driver including a housing, a magnetic circuit, a coil, an armature magnetized by a magnetic field of the coil to interact with the magnetic circuit, a rod vertically connected to the armature, and a diaphragm vibrated by the rod;

a bracket coupled to an upper portion of the diaphragm of the dynamic driver and having a sound emission port configured to emit sound of the dynamic driver, wherein the bracket has a balanced armature driver accommodation space on an upper surface thereof, the balanced armature driver is disposed such that the diaphragm is parallel to the upper surface of the bracket, and the housing has a sound emission hole above the diaphragm; and a protective cap configured to surround the balanced armature driver.

* * * * *